US009303370B1

(12) United States Patent
Hershberger et al.

(10) Patent No.: US 9,303,370 B1
(45) Date of Patent: Apr. 5, 2016

(54) SPREADER TRUCK VACUUM SYSTEM

(71) Applicant: Stoltz Manufacturing, LLC, Morgantown, PA (US)

(72) Inventors: Bernard J. Hershberger, Lancaster, PA (US); Tyler Martikainen-Watcke, Reading, PA (US)

(73) Assignee: Stoltz Mfg., LLC, Morgantown, PA (US)

( * ) Notice: Subject to any disclaimer, the term of this patent is extended or adjusted under 35 U.S.C. 154(b) by 0 days.

(21) Appl. No.: 14/600,108

(22) Filed: Jan. 20, 2015

(51) Int. Cl.

| | |
|---|---|
| ***E01C 21/00*** | (2006.01) |
| ***E01C 19/12*** | (2006.01) |
| ***B01D 46/48*** | (2006.01) |
| ***B01D 46/00*** | (2006.01) |

(52) U.S. Cl.
CPC ..... *E01C 19/12* (2013.01); *B01D 46/0002* (2013.01); *B01D 46/0041* (2013.01); *B01D 46/48* (2013.01); *E01C 21/00* (2013.01)

(58) Field of Classification Search
CPC ..... B01D 46/0002; B01D 46/0041; B01D 46/48; E01C 19/12; E01C 21/00
See application file for complete search history.

(56) References Cited

U.S. PATENT DOCUMENTS

| | | | | | |
|---|---|---|---|---|---|
| 4,561,145 | A * | 12/1985 | Latham | E01C 23/08 | 15/340.3 |
| 4,781,556 | A * | 11/1988 | Paul | E01C 23/098 | 404/107 |
| 5,032,658 | A * | 7/1991 | Baron | G02B 1/043 | 359/642 |
| 5,236,275 | A * | 8/1993 | Kneeland | E01C 19/4826 | 404/107 |
| 5,251,999 | A * | 10/1993 | McCracken | E01C 23/06 | 404/109 |
| 5,333,969 | A * | 8/1994 | Blaha | E01C 19/46 | 404/102 |
| 5,605,381 | A * | 2/1997 | Schmoock, Jr. | E01C 23/0885 | 299/39.2 |
| 5,938,371 | A * | 8/1999 | Gustin | E01C 19/48 | 404/101 |
| 6,171,017 | B1 * | 1/2001 | Watkins | E01C 23/06 | 404/72 |
| 2006/0204333 | A1 * | 9/2006 | Musil | E01C 19/48 | 404/95 |
| 2009/0050341 | A1 * | 2/2009 | Hathaway | A01B 33/021 | 172/321 |
| 2013/0056233 | A1 * | 3/2013 | Gift | E02F 3/9293 | 172/123 |

* cited by examiner

*Primary Examiner* — Raymond W Addie
(74) *Attorney, Agent, or Firm* — Law Office of Steve O'Donnell; Steve O'Donnell

(57) ABSTRACT

A vacuum system for a spreader truck takes up dust generated when the spreader truck's payload is deposited and blows it back into the truck where some fraction of the dust is reclaimed as it settles out of the air. Any dust remaining airborne is removed by a filter apparatus before the cleaned air is released.

10 Claims, 10 Drawing Sheets

SPREADER TRUCK VACUUM SYSTEM

FIELD OF THE INVENTION

The subject matter of this application pertains to dust and particulate vacuum collection and reclamation systems. More particularly, the subject matter of this application pertains to dust and particulate collection vacuum collection and reclamation systems useful during soil stabilization. The system comprise a part of a spreader truck and draws dust and particulate laden air from above a newly deposited layer of soil stabilizing material back into the spreader truck where a predominant fraction of the dust settles out from the air. This air is then pushed through a filter apparatus so only clean air is ejected back to the outside of the spreader truck.

BACKGROUND

Soil stabilization is the process of improving certain characteristics of soil through the addition of materials. It is most commonly used to increase the load bearing capability of soil and to harden it. This process results in a subbase and base course suitable for serving as a foundation for roads, parking lots, runways, driveways, and other pavement structures. A subbase may also be the top layer for certain footpaths or asphalt-free roads (often colloquially called "gravel roads.")

Soil stabilization increases the soil strength, which increases the structural integrity of pavement placed on top of it, thereby lowering maintenance costs and maximizing the lifespan of the pavement.

Several types of materials may be used alone or in combination to stabilize the soil, depending on the natural characteristics of the soil itself and on the intended purpose of the final product. Among these compounds are Portland cement, lime, gypsum, fly ash, silica, bentonite and certain metal oxides. One common characteristics of these compounds is that they are dusty.

Often, the stabilizing compounds are loaded into a spreader truck, which deposits a layer of its contents as it drives over the work area. Additional material may then be laid, or otherwise processed.

Although the compounds may only drop several inches to the ground from the truck a large amount of dust can be generated. The dust is not only unsightly, but also difficult, and potentially hazardous, to breathe. Further, the dust that escapes is a loss of material that would otherwise be useful.

The invention of U.S. Pat. No. 4,990,025 uses water to prevent or reduce dust created by tilling soil while adding a stabilizing compound. In particular, it disclosed a system where by a tiller is tilling soil, while a truck containing water drives alongside the tiller, supplying it with water, and another truck containing a filler/binding material is also connected to the tiller and driving alongside it.

U.S. Pat. No. 4,061,221 discloses a flexible skirt that prevents dust from spreading until it is sucked into a collector.

Another dust-preventing flexible skirt is disclosed in U.S. Pat. No. 8,342,772. This design uses nested skirts to prevent dust from escaping and allowing it to settle to the ground.

U.S. Pat. No. 6,175,702 utilizes a vacuum system for eliminating dust in which a vacuum blower draws dusty air from a hood mounted near where the material is deposited and pulls this air though filter media contained in a dust collecting unit, resulting in cleaned air exiting the vacuum system, and in a rapidly filling, first-pass, dust collecting unit.

SUMMARY

The subject matter of this application relates to vacuum systems. More particularly, it pertains to vacuum systems that comprise part of a spreader truck which spreads soil stabilizing materials such as Portland cement, lime, gypsum, fly ash, silica, bentonite and certain metal oxides.

One objective of the subject matter of this application is to reduce or eliminate the dust generated by a spreader truck depositing material. A further objective of the subject matter of this application is to recycle the generated dust so it can be deposited again rather than being discarded.

In use, a spreader truck contains material held in a storage area. When in use, a spreader truck is driven over an area and the material falls from a dispenser to the ground below. This dispensing of material generates a significant amount of dust which, if left to disperse, not only pollutes the immediate area, but in windier conditions, can also pollute distant properties such as houses or businesses. The dust generated is also dangerous to breathe, not necessarily because it is poisonous, but simply because it may cause aspiration pneumonia.

The subject matter of this application comprises a vacuum and air cleaning system which reclaims the generated dust. In a most preferred embodiment, a spreader truck comprises a disclosed vacuum system, although the subject matter of this application may be applied to other dust generating means. The vacuum system comprises at least one vacuum hood located adjacent to the dispenser, or source of the dust. A partial vacuum within the hood is generated by a vacuum unit, such as a pressure blower. The partial vacuum causes dust generated from the deposited material to be drawn up and blown into the truck's material storage area. Once in the material storage area, a predominate fraction of the captured dust settles out so that when the air reaches the air outlet of the material storage area, the majority of the dust has been removed by natural forces. The mostly clean air then travels though a filter apparatus to remove substantially all of the remaining dust before the air is released from the vacuum system.

The vacuum system largely prevents the escape of dust caused by soil stabilizing materials being released from a spreader truck. It also reclaims the dust, allowing the particulates to settle to be later deposited again by the spreader truck. Since the predominate fraction of dust settles out when the air is blown into the material storage area and before the air passes through the filter apparatus, the filter media needs to be cleaned or replaced less frequently than it would if the dusty air passed through the filter apparatus without first going through a settling stage.

BRIEF DESCRIPTION OF THE ILLUSTRATIONS

Figure 9:
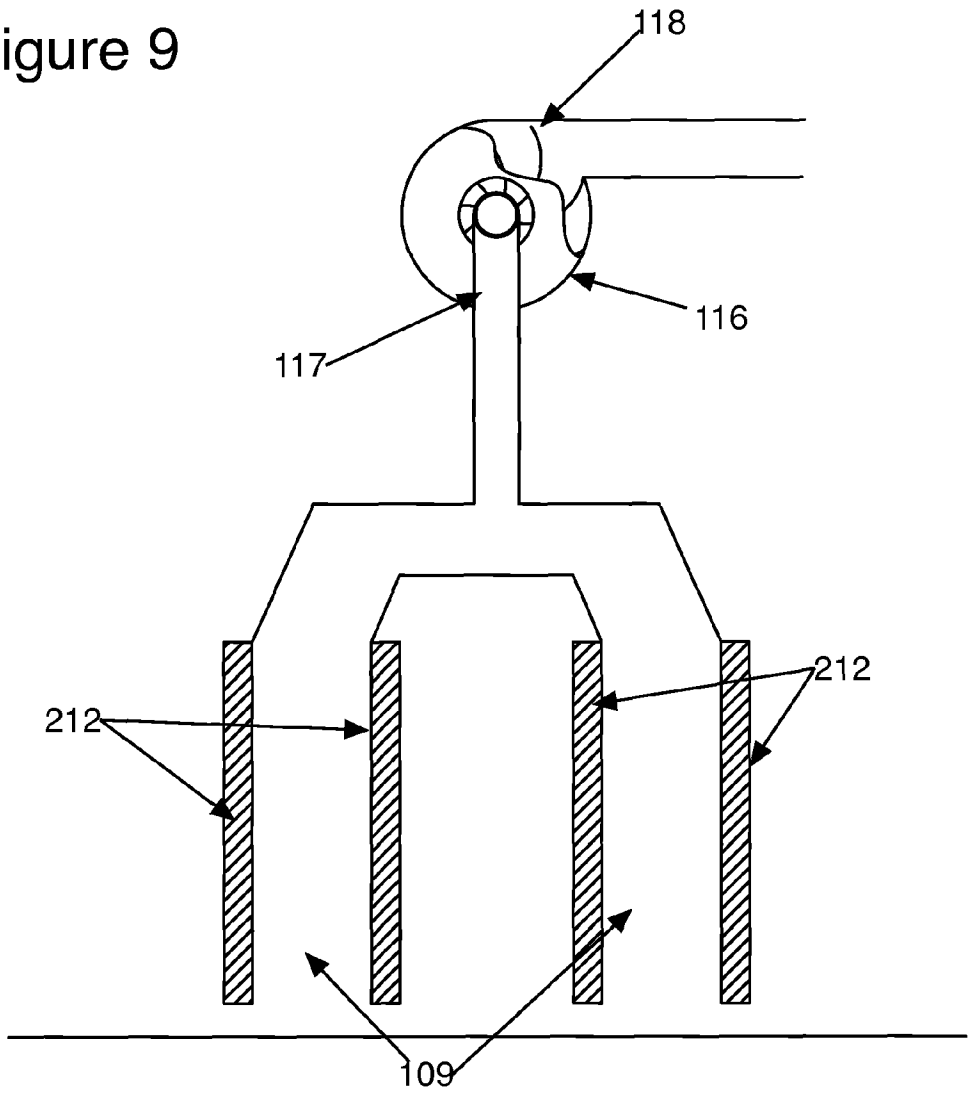

FIG. 9 a schematic of the inlet from a dual-vacuum hood design with one blower.

Figure 10:
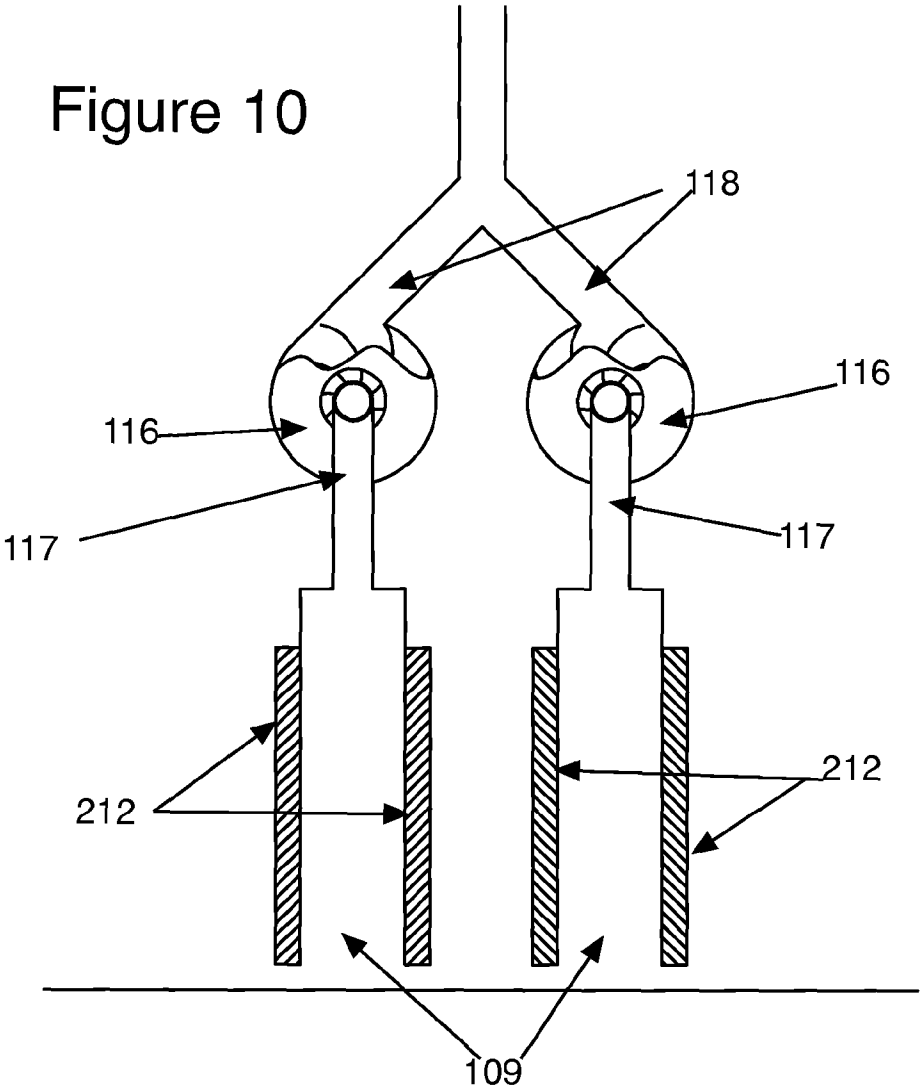

FIG. 10 is a schematic of the inlet from an alternate dual-vacuum hood design with two blowers.

DETAILED DESCRIPTION OF THE ILLUSTRATION

The following description and drawings referenced therein illustrate embodiments of the application's subject matter. They are not intended to limit the scope. Those familiar with the art will recognize that other embodiments of the disclosed method and apparatus are possible. All such alternative embodiments should be considered within the scope of the application's disclosure.

Each reference number consists of three digits. The first digit corresponds to the figure number in which that reference number is first shown. Reference numbers are not necessarily discussed in the order of their appearance in the figures.

Although the subject matter of this application pertains to vacuum systems of use in spreader trucks, the subject matter of this application may have utility in other applications. References below to common features of spreader trucks are shown and described to give context to the disclosed vacuum system and should not be interpreted to restrict the claims unless a claim explicitly incorporates such a limitation. As used in this application, pipe shall be defined as any pipe, channel, conduit, duct, or other physical communication means connecting spaces or components of the subject matter of this application.

A spreader truck (101) comprises a material storage area (102), a dispenser (103), and an ejection means (201) for moving material towards the dispenser. The truck further comprises a longitudinal axis (202) having a caudal end (203) at the rear of the truck and a rostral end towards the front of the truck (204). The spreader truck further comprises a loading pipe (104) comprising a bend (105) and having an inlet (106) and an outlet (107), whereby material (205) such as soil stabilizers can be loaded into the truck. The truck also comprises a venting pipe (206) comprising a bend (207), an inlet (208), and an outlet (209), the venting pipe's outlet terminates in a filter apparatus (108) that removes dust generated inside the material storage area during the material loading and reclamation processes.

Figure 1:
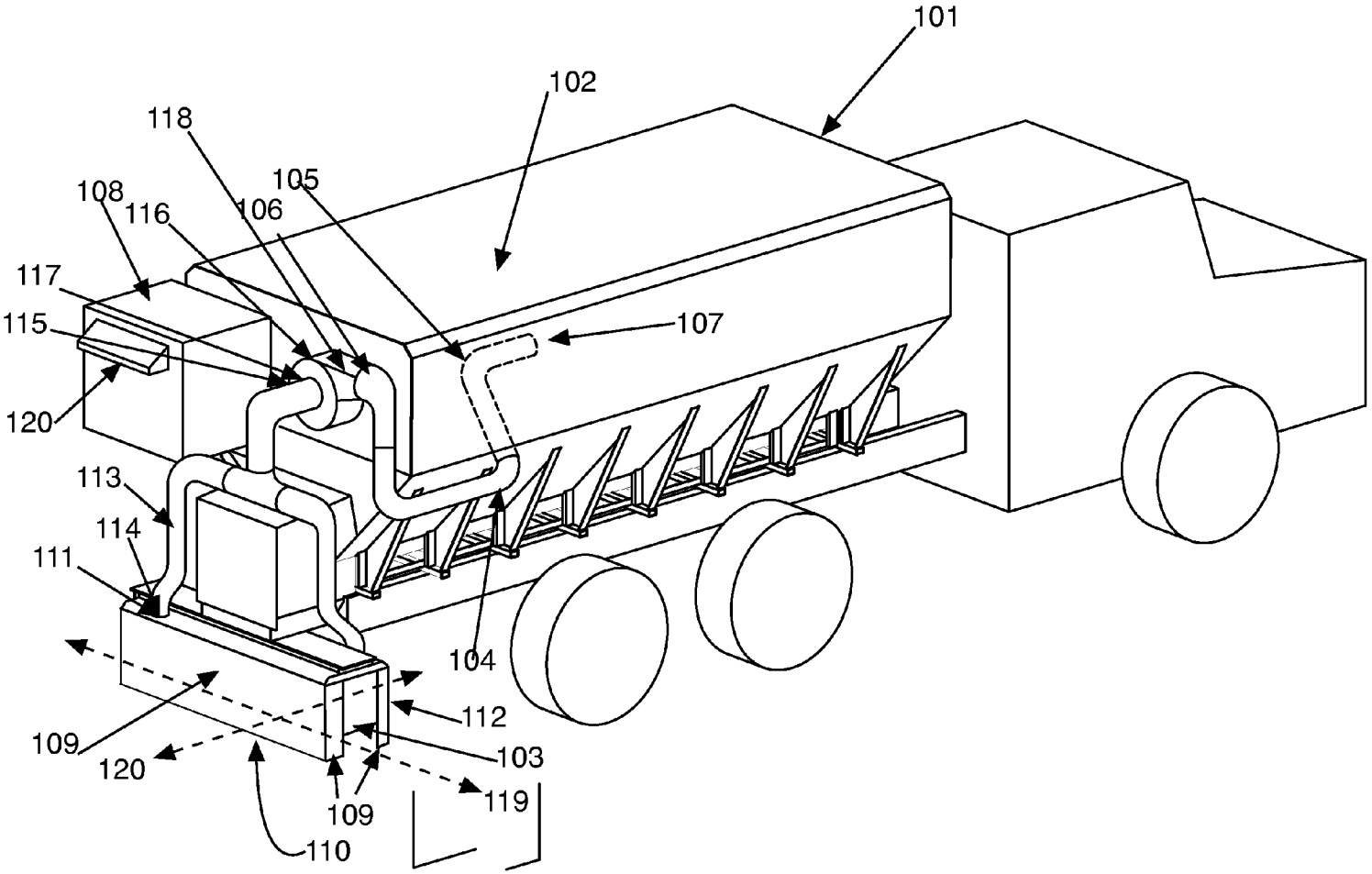
FIG. 1 illustrates a spreader truck comprising the subject matter of this application.
Figure 2:
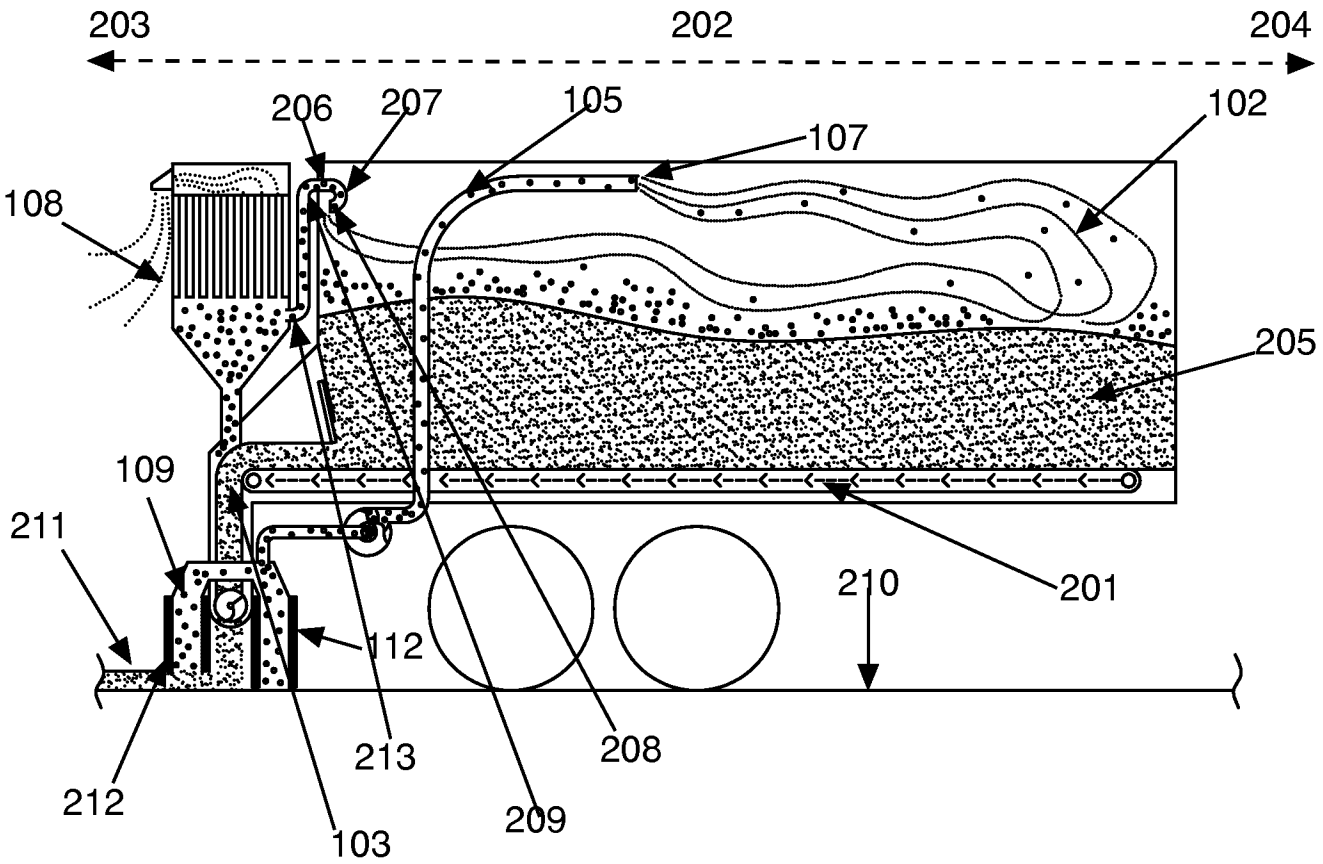
FIG. 2 shows a section of the spreader truck of having an alternate loading pipe design than that shown in FIG. 1.
Figure 3:
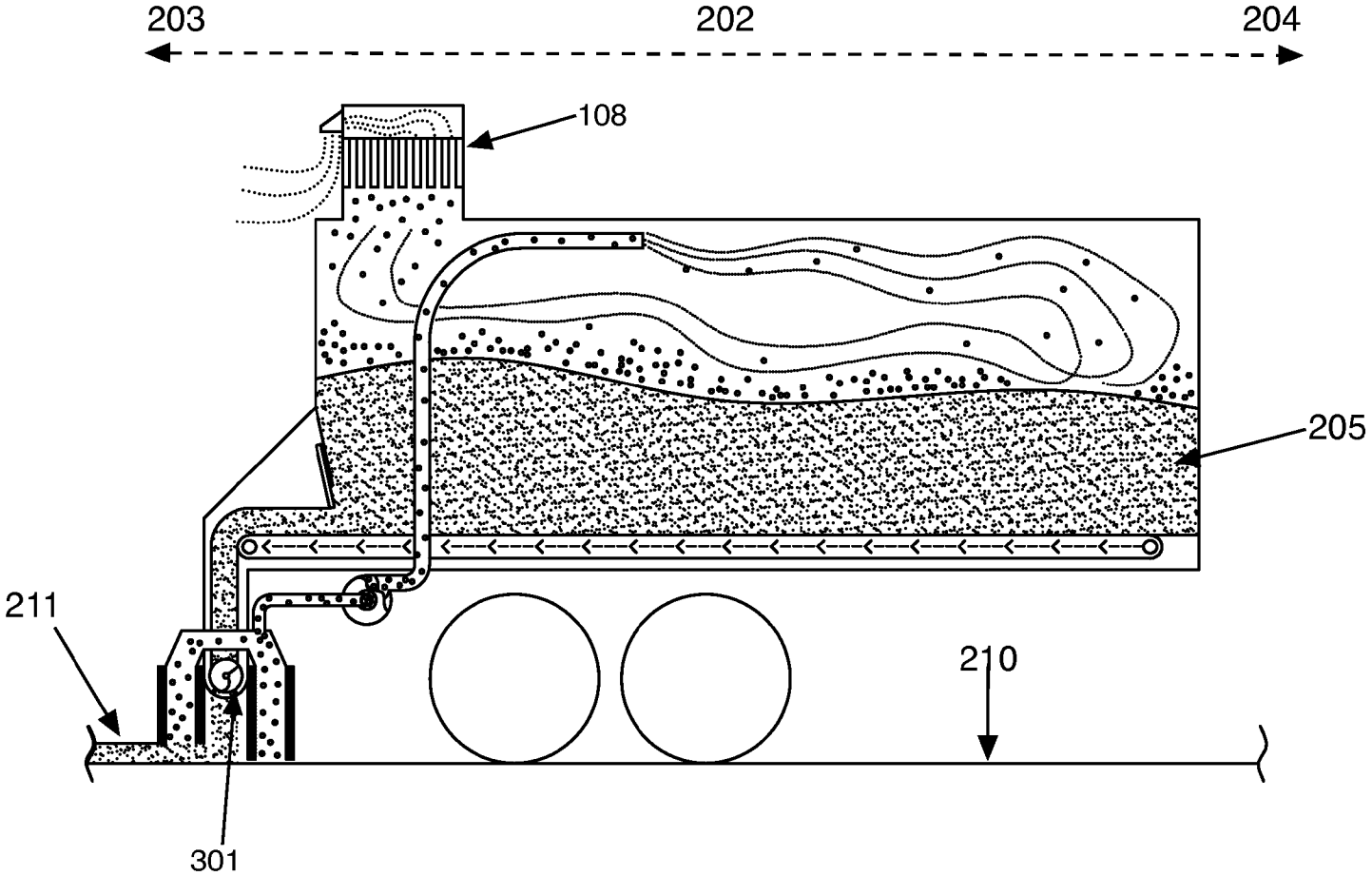
FIG. 3 illustrates an alternate design and placement of the filter apparatus.

As material is blown into the material storage area via a loading vessel (not shown) reversibly coupled to the truck's loading pipe, it is ejected towards the rostral end of the truck through the loading pipe's outlet (107). Obviously, to prevent the loss of dusty air, the material storage area is substantially sealed from the outside except for the portals needed for the loading pipe and the venting pipe. This process fills the material storage area, and also generates airborne dust. As more material is blown into the material storage area, the dusty air is forced through the venting pipe leading to a filter unit (108). In the inventors experience, when a spreader truck is loaded with 27 tons of cement between approximately 20 and 50 pounds of dust (0.037-0.092%) is captured by the filter unit. It should be apparent that heavier-than-air particles are temporarily suspended in air when blown out of a loading pipe, and that these particles will settle out of the air primarily as functions of time and particle density. Collision of the airborne particles with other particles or surfaces may also increase settling rate. The bend in the loading pipe (105) causes the spray of material to be directed away from the venting pipe (206), forcing the generated particulate-laden air to flow to the back of the truck before it exits though the venting pipe (the general flow of air is shown in FIGS. 2 and 3 as dotted lines and larger dots are shown to indicate particulates suspended in the air and falling to the bed of stored material). The bend or bends in the venting pipe further require the air to change direction, and causes a portion of the dust still carried by the air to strike the rear wall of the material storage are before entering the vent pipe. These structural features of the loading and venting pipes increase the probability that dust generated by the filling process falls out of the air before the air reaches the filter unit.

When in use, the spreader truck is driven over a target area and the ejection means (201) moves the stored material to a dispenser (103) where it contacts an auger (301) before falling to the ground (210). At least one vacuum hood (109) comprising an inlet (110) and an outlet (111) is located adjacent to the dispenser (103). Some embodiments may have one vacuum hood, adjacent to, and preferably to the rear of the dispenser, however the most preferred embodiment comprises two vacuum hoods, each located adjacent to the dispenser, with one hood (109) to the rear of the dispenser, and another hood caudal of the dispenser (112). References to a vacuum hood should be understood to encompass single-hood, and dual-hood embodiments unless otherwise indicated. The inlet of the vacuum hood has a longitudinal axis parallel to the width of the spreader truck and a transverse axis, and the inlet terminates near the surface of the target area, ideally within a few microns from the top of the freshly deposited material (211), however in practice, and as further described below, a much larger space may be utilized to minimize the occurrences of the vacuum hood scraping the freshly deposited material.

The outlet of the vacuum hood is attached to a first communication means (113) having an inlet (114) and an outlet (115). The communication means' inlet is attached to the outlet of the vacuum hood. The communication means' outlet is attached to a vacuum means (116). In preferred embodiments, this vacuum means is a blower comprising an inlet (117) and an outlet (118), in which the vacuum means' inlet is attached to the first communication means' outlet, and the vacuum means' outlet is attached to a second communication means (also known as the loading pipe, 104). This second communication means also comprises an inlet (106) and an outlet (107).

Figure 8:
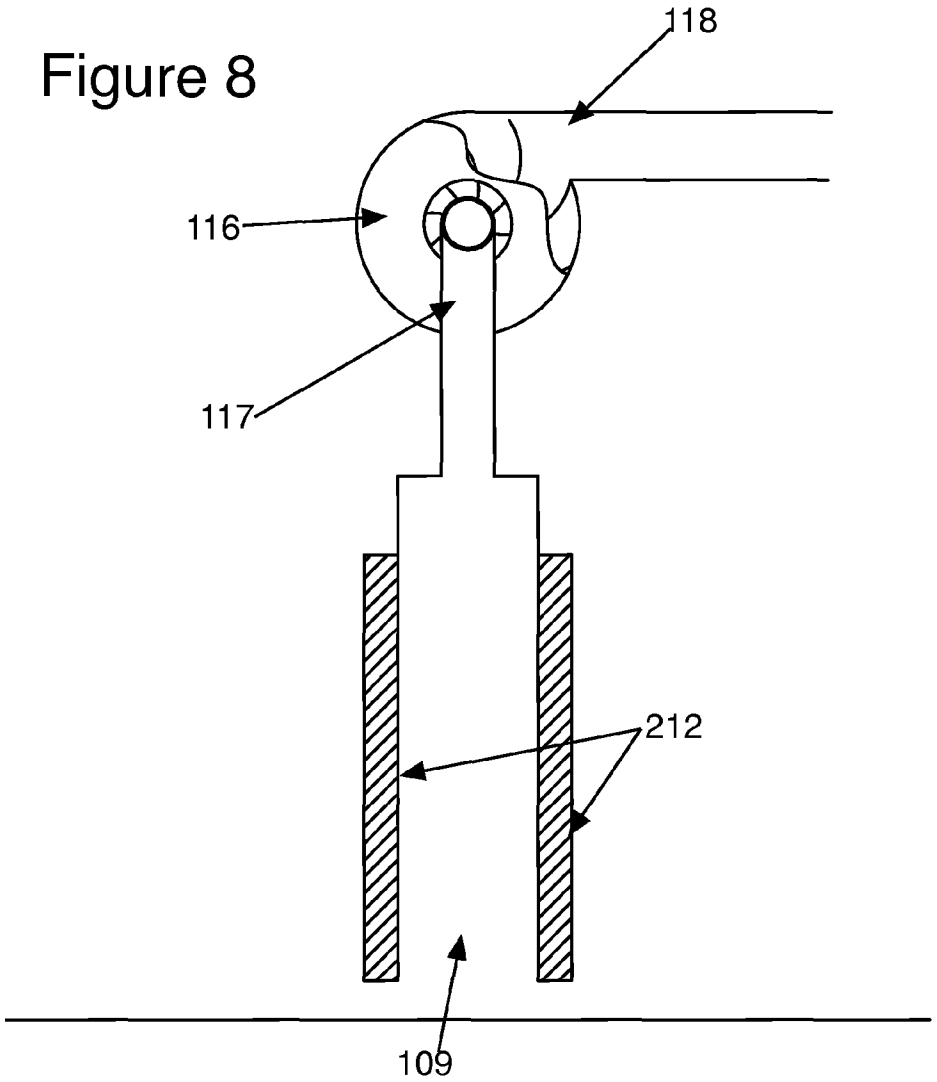
FIG. 8 is a schematic of the inlet from a single-vacuum hood design.

In single vacuum hood embodiments, normally only one blower will be required (FIG. 8). The more preferred dual-vacuum hood embodiments may utilize a one (FIG. 9) or two (FIG. 10) blower design. Certainly, other combinations of vacuum means exist and such should be interpreted to fall within the scope of this application.

In a preferred embodiment the dimensions of the vacuum hood's inlet is roughly eight feet along it's longitudinal axis (119) and one foot along its transverse (120) axis. A vacuum pressure of approximately 1 pound/inch^2 within the vacuum hood is sufficient to draw the predominant fraction of generated dust up through the hood and towards the vacuum means. Lower, even much lower vacuum pressures, may also be sufficient for the purposes of this application, depending largely on the physical characteristics of the generated dust. Such determination is easily determined with routine experimentation. As used herein, the "predominate fraction" of generated dust is at least 70% of the generated dust by volume. When the spreader truck is in movement, variations or "bumps" in the road surface may cause the vacuum pressure in the vacuum hood to fluctuate. In a preferred embodiment, to mitigate the effect of this possible fluctuation, the vacuum hood further comprises a vacuum sensor (401) which continually or periodically samples the vacuum pressure. When pressure fluctuations are detected, a relay (not shown) between the sensor and the vacuum means can cause the vacuum means to increase the generated vacuum pressure.

This relay may be an integrated circuit, or it may comprise a computing device, or it may rely on manual adjustment of the vacuum means by a person receiving notification of the pressure fluctuation.

Figure 4:
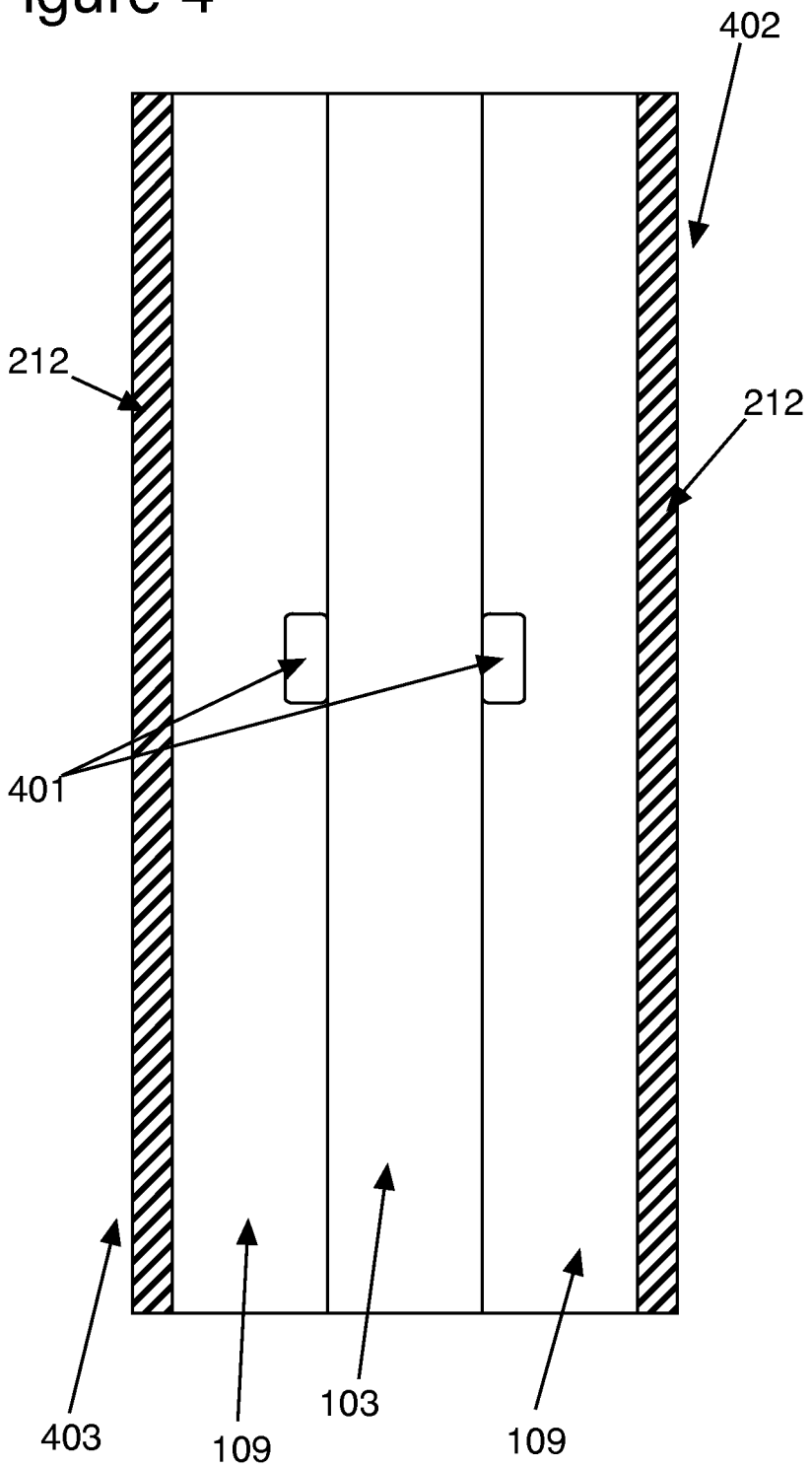
FIG. 4 illustrates a bottom view of the dispenser and an embodiment of the vacuum hoods.
Figure 5:
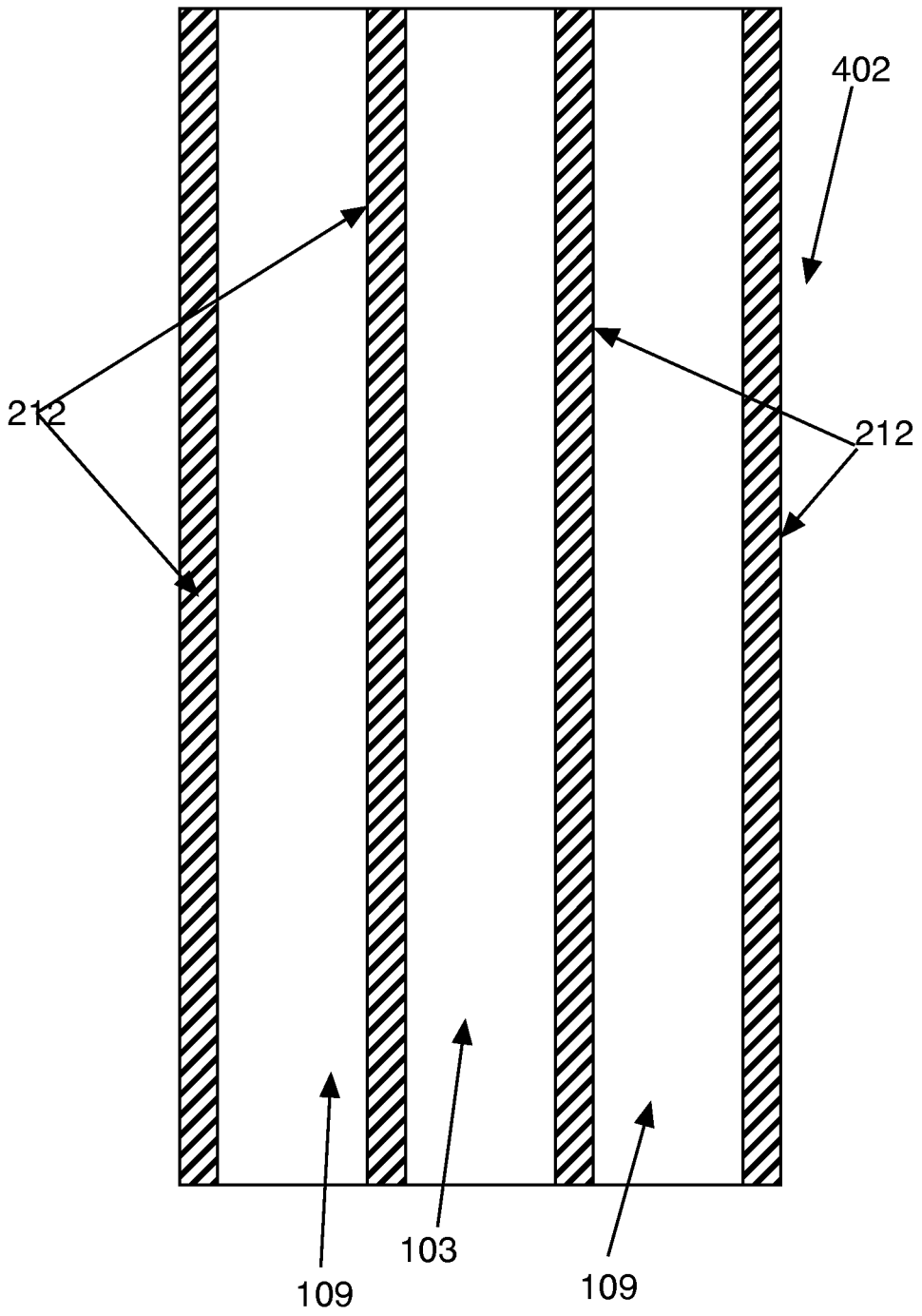
FIG. 5 illustrates a bottom view of the dispenser and an embodiment of the vacuum hoods.
Figure 7:
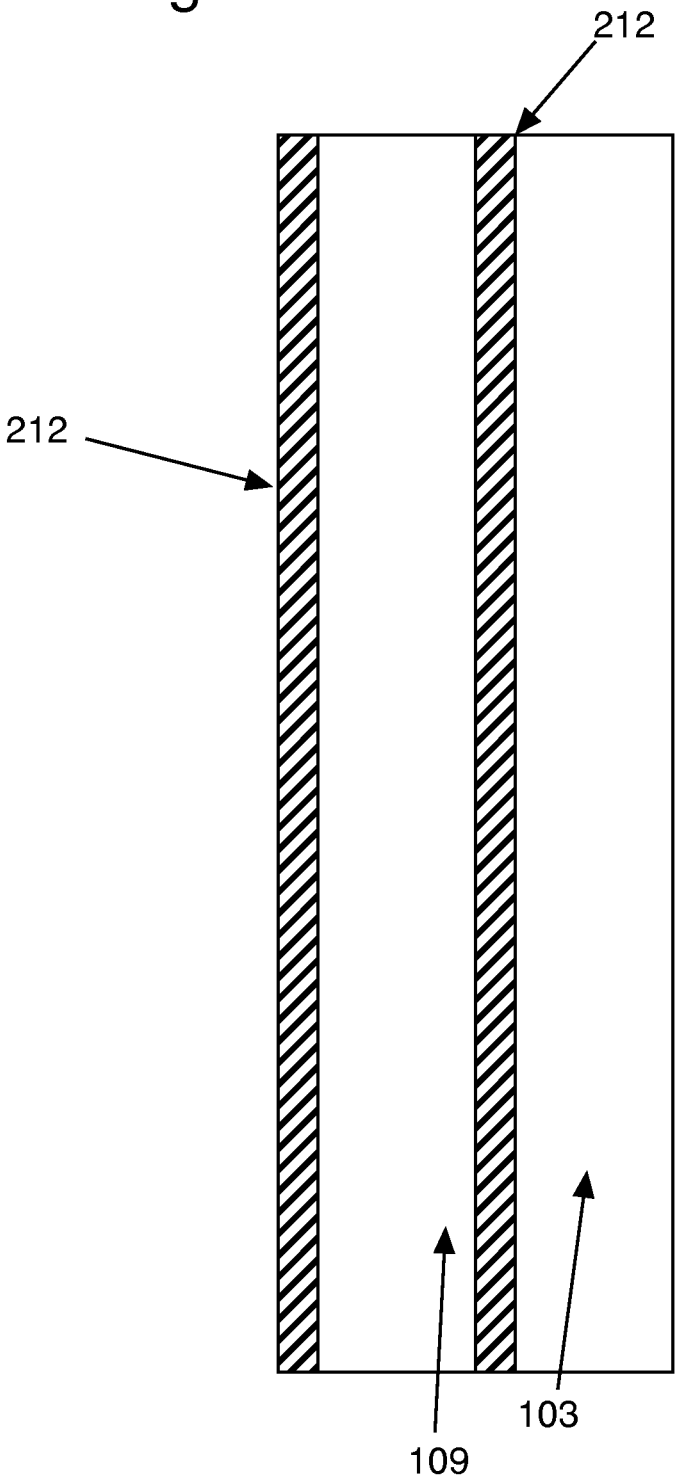
FIG. 7 illustrates a bottom view of the dispenser and a most highly preferred embodiment of the vacuum hoods.

The vacuum hood or hoods may also comprise one or two curtains (212), parallel to a vacuum hood's longitudinal axis, and located adjacent to the vacuum hood that extend further towards the top of the freshly deposited material than does the inlet of the vacuum hood. In this manner, a solid vacuum hood may terminate several inches from the top of the ground, yet the desired vacuum pressure is largely maintained to the bottom of the curtain or curtains without needing to increase the vacuum pressure generated by the vacuum means to account for a large gap between the vacuum hood and the ground surface. In this way, the comparatively inexpensive curtains would sustain any damage caused by scraping against the ground surface instead of a more expensive and difficult to replace solid vacuum hood. The curtains are preferably constructed of a heavy material, such as a durable rubber so that the curtains do not overly sway as the truck moves. The curtains may be mounted so they terminate within several millimeters of the ground, or they may be mounted such that they drag across the ground. If they drag, the ground will scrape away the parts of the curtains it contacts, leaving the ends of the curtains as close to the ground as possible. In single vacuum hood embodiments (FIG. 7), the vacuum hood may be adjacent and either rostral, or caudal to the dispenser, and may comprise one or two curtains. each curtain being adjacent and either rostral, or caudal, to their associated vacuum hood (FIGS. 4 and 5). Embodiments comprising a plurality of vacuum hoods located rostral and caudal to the dispenser are preferred.

Figure 6:
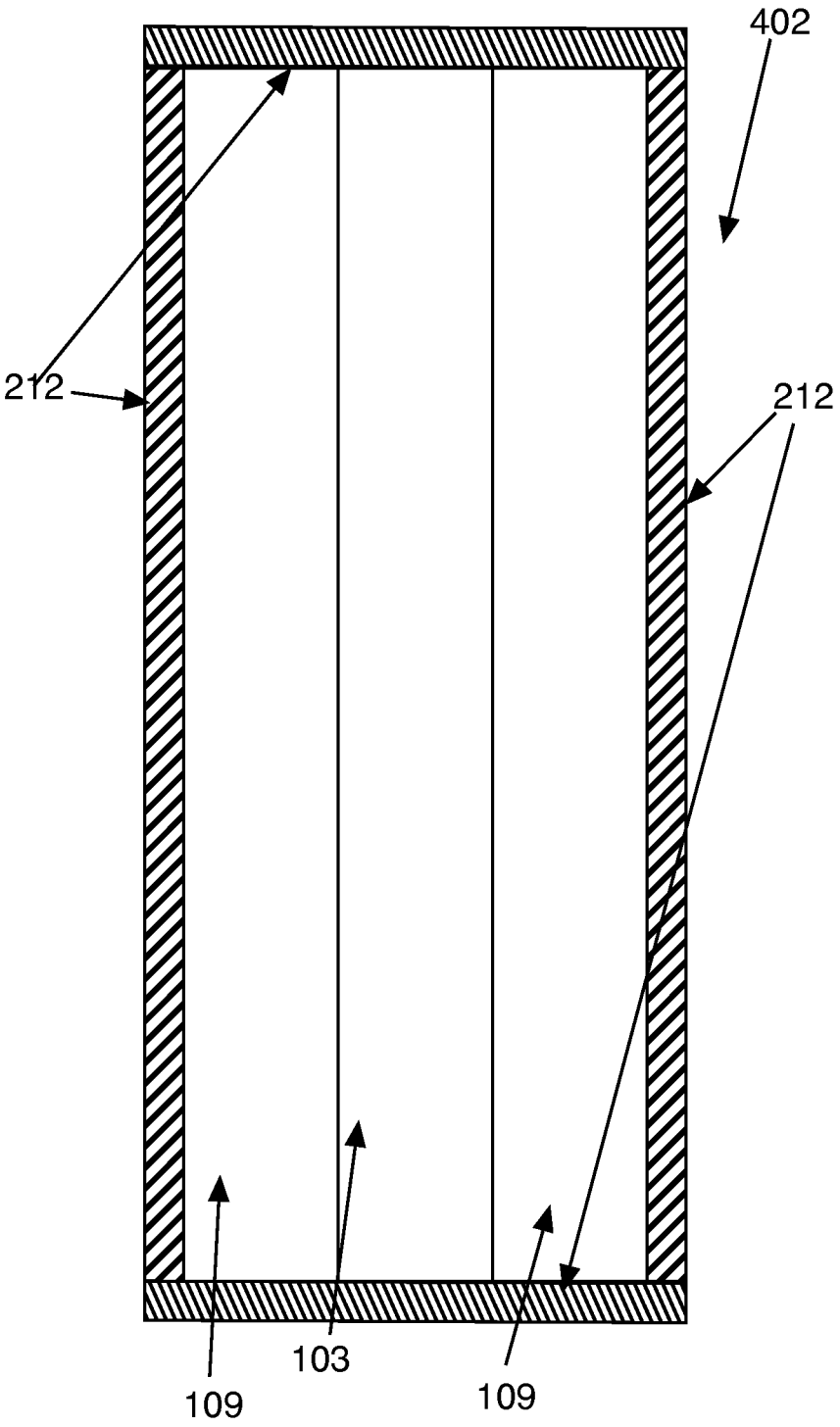
FIG. 6 illustrates a bottom view of the dispenser and an embodiment of the vacuum hoods.

In dual vacuum hood, and single curtain embodiments (FIG. 4), the curtain may be located towards the front of the truck (402) or the rear of the truck (403), provided it is adjacent to its associated vacuum hood, although dual curtain embodiments are highly preferred (FIG. 5). In some embodiments, the curtains may be attached to the truck, to the vacuum hood itself, or to another surface. In preferred embodiments, the curtains are continuous with the vacuum hood or hoods. In a most highly preferred embodiment, the two or more curtains associated with a vacuum hood may be joined to form a continuous, or mostly continuous, skirt (FIG. 6, 212) around the vacuum hood. Obviously, such a skirt may be formed from a single, continuous piece of material instead of by the joining of two curtains. More preferably, such a skirt surrounds not only its associated vacuum hood, but also surrounds the dispenser (103). In the most highly preferred embodiment, a first vacuum hood is located rostral and adjacent to the dispenser and a second vacuum hood is located caudal and adjacent to the dispenser and a single skirt of material (FIG. 6) at least partially surrounds the caudal portion of the second vacuum hood, the rostral portion of the first vacuum hood, and the dispenser located between the two vacuum hoods.

In more highly preferred embodiments, the vacuum hoods are themselves flexible and instead of comprising curtains, simply extend to, or near to the ground as desired.

In yet another embodiment (not shown), the skirts or curtains are nested within another layer of similarly constructed skirts or curtains (the "outer" skirts or curtains). In such embodiments, the outer skirts or curtains are preferably shorter (i.e., they terminate further from the ground surface) than the inner skirts or curtains so that dust generated by the scraping of the inner skirts or curtains can be constrained by the outer skirts or curtains.

The vacuumed dust passes though the vacuum hood to the vacuum hood's outlet (111), then to the inlet (114) of the first communication means, passes through the first communication means (113), though the first communication means' outlet (115), and to the inlet (117) of the vacuum means (116). At this point, the dust is no longer pulled towards the vacuum means, but is rather pushed from the vacuum means. The dust passes through the outlet of the vacuum means (118) and into the inlet (106) of the second communication means (otherwise known as the loading pipe). The dust then passes through this communication means (104), and is ejected from the second communication mean's' outlet (107) towards the front of the truck (204).

In the truck, the dust-laden air, initially ejected towards the front of the truck, is forced to move towards the venting pipe as more dusty air is pushed into the truck by the vacuum means. As this air moves in the truck, the dust particles collide with each other, the sides of the material storage area, and with the stored material itself. The collisions slow the dust, allowing it to settle out of the air and be deposited primarily on top of the stored material (the airflow is shown in FIGS. 2 and 3 as dotted lines; larger dots are used to indicate airborne particulates settling out of the air). It is estimated that in the case of the material being cement, more than 99% of the dust blown into the material storage until will settle out of the air before the it leaves the material storage area. That percentage will likely vary as a function of the density and size of the dust particles, with less dense and smaller particles being more likely to remain in the air and more dense and larger particles being less likely to remain in the air. However, in all expected circumstances the predominate fraction of dust in the air will settle out and be deposited on top of the stored material before the air moves to the next stage.

The air, now predominately free of dust, moves into the inlet (208) of the venting pipe (206), past the bend in the venting pipe (207), and then out of the venting pipe's outlet (209) to a filter unit (108).

Suitable filter units are well known and routine experimentation will lead one to a filter unit appropriate for the air exiting the venting pipe. The filter unit may be as simple as a box comprising an inlet, a household HVAC filter, and an outlet. More preferably, the filter unit (108) comprises a housing containing at least one cartridge-type filter, an inlet (213) in communication with the venting pipe's outlet, an outlet blowing out clean air (120), and at least one access point allowing an operator to remove collected dust and replace the filters as needed (not shown). A preferred embodiment of the filter unit comprises a baghouse filter although the preferred type of filter, as well as the filter's surface area and filter cleaning method are either easily discerned by those in the relevant arts or obtainable through routine experimentation. It should be evident that the dusty air passes though the filter before being released through the outlet.

Now, having described the invention, we claim:

1. A vacuum system for capturing airborne particulates, above a traffic way comprising: vacuum hood, a material storage area, at least one vacuum generating means, and a filter unit such that a. said vacuum hood comprises an inlet and an outlet,
   i. said inlet positioned to capture the airborne particulates, and
   ii. an outlet in communication with a vacuum means; and b. said vacuum generating means having an inlet and an outlet, and being capable of i. generating at vacuum sufficient to draw a predominate fraction of airborne particulates located under the vacuum hood into the vacuum hood, ii. drawing air and airborne particulates from the vacuum hood, iii. and pushing said air and airborne particulates from the vacuum generating means' outlet to the material storage area via a communication means; and c. said material storage area comprises an inside and an outside, a front and a back, a longitudinal axis, a width perpendicular to its longitudinal axis and is i. substantially impermeable to air such that dust blown into the material storage area does not exit the material storage area except thought the venting pipe; and d. said filter unit comprising an inlet, an outlet, and filter media, in which i. the inlet is in communication with the material storage unit via the venting pipe, ii. the outlet releases substantially dust-free air, and iii. the filter media is located between the filter unit's inlet and outlet so that air is forced to pass through the filter media before being released through the filter unit's outlet.

2. A spreader truck comprising the vacuum system of claim 1 in which a. the material storage area is a vessel for storing a volume of material, b. the inlet of the loading pipe may be uncoupled from the communication means between the loading pipe and the the outlet of the vacuum generating unit, c. the spreader truck further comprises a dispenser and material movement means to discharge the said material such that d. the spreader truck drives over an area having a post-dispensed surface and a pre-dispensed surface lower than the post-dispensed surface, and e. the vacuum hood is located adjacent to the dispenser, f. the vacuum generating means is located outside the truck, g. the venting pipe is substantially inside the material storage area, and h. the filter unit is mounted on the outside of the material storage unit.

3. A spreader truck comprising the vacuum system of claim 1 in which a. the material storage area is a vessel for storing a volume of material, b. the inlet of the loading pipe may be uncoupled from the communication means between the loading pipe and the the outlet of the vacuum generating unit, c. the spreader truck further comprises a dispenser and material movement means to discharge the said material such that d. the spreader truck drives over an area having a post-dispensed surface and a pre-dispensed surface lower than the post-dispensed surface, and e. the vacuum hood is located adjacent to the dispenser and caudal from both the dispenser and from the front of the material storage area, and i. comprises a width and a depth, a) said width being perpendicular to the material storage areas's longitudinal axis and substantially the same same width as the material storage area, and b) said depth being parallel to the material storage area's longitudinal axis, and;

f. the vacuum generating means is located outside the truck, g. the venting pipe is substantially inside the material storage area, and h. the filter unit is mounted on the outside of the material storage unit.

4. A spreader truck comprising the vacuum system of claim 1 in which a. the material storage area is a vessel for storing a volume of material, b. the inlet of the loading pipe may be uncoupled from the communication means between the loading pipe and the the outlet of the vacuum generating unit, c. the spreader truck further comprises a dispenser and material movement means to discharge the said material such that d. the spreader truck drives over an area having a post-dispensed surface and a pre-dispensed surface lower than the post-dispensed surface, and e. the vacuum hood is located adjacent to the dispenser and caudal from both the dispenser and from the front of the material storage area, and i. comprises a width and a depth, a) said width being perpendicular to the material storage areas's longitudinal axis and substantially the same same width as the material storage area, and b) said depth being parallel to the material storage area's longitudinal axis, and further comprises a curtain of material having a top and a bottom, (1) said top being attached to the vacuum hood, and (2) said bottom extending substantially to the post-dispensed surface; and f. the vacuum generating means is located outside the truck, g. the venting pipe is substantially inside the material storage area, and h. the filter unit is mounted on the outside of the material storage unit.

5. A spreader truck comprising the vacuum system of claim 1 in which a. the material storage area is a vessel for storing a volume of material, b. the inlet of the loading pipe may be uncoupled from the communication means between the loading pipe and the the outlet of the vacuum generating unit, c. the outlet of the loading pipe is located within the material storage area and is oriented so air and material is blown towards the front of the material storage area, and d. the spreader truck further comprises a dispenser and material movement means to discharge the said material such that e. the spreader truck drives over an area having a post-dispensed surface and a pre-dispensed surface lower than the post-dispensed surface, and f. the vacuum hood is located adjacent to the dispenser and caudal from both the dispenser and from the front of the material storage area, and i. comprises a width and a depth, a) said width being perpendicular to the material storage areas's longitudinal axis and substantially the same same width as the material storage area, and b) said depth being parallel to the material storage area's longitudinal axis, and further comprises a curtain of material having a top and a bottom, (1) said top being attached to the vacuum hood, and (2) said bottom extending substantially to the post-dispensed surface; and g. the vacuum generating means is located outside the truck, h. the venting pipe is substantially inside the material storage area, and i. the inlet of the loading pipe is oriented so that it faces the rear of the material storage area, and j. the filter unit is mounted on the outside of the material storage unit.

6. A vacuum system for capturing airborne particulates, above a traffic way comprising: first vacuum hood, second vacuum hood, a material storage area, at least one vacuum generating means, and a filter unit such that a. said first and second vacuum hoods each comprise an inlet and an outlet, i. each said inlet positioned to capture the airborne particulates, and ii. each said outlet in communication with a vacuum means; and b. said vacuum generating means having an inlet and an outlet, and being capable of i. generating a vacuum of at least 1 pound/inch^2 within the vacuum hood, ii. drawing air and airborne particulates from the vacuum hood, iii. and pushing said air and airborne particulates from the vacuum generating means' outlet to the material storage area via a communication means; and c. said material storage area comprises an inside and an outside, a front and a back, a longitudinal axis, a width perpendicular to its longitudinal axis and is i. substantially impermeable to air such that dust blown into the material storage area does not exit the material storage area except thought the venting pipe; and d. said filter unit comprising an inlet, an outlet, and filter media, in which i. the inlet is in communication with the material storage unit via the venting pipe, ii. the outlet releases substantially dust-free air, and iii. the filter media is located between the filter unit's inlet and outlet so that air is forced to pass through the filter media before being released through the filter unit's outlet.

7. A spreader truck comprising the vacuum system of claim 6 in which a. the material storage area is a vessel for storing a volume of material, b. the inlet of the loading pipe may be uncoupled from the communication means between the loading pipe and the the outlet of the vacuum generating unit, c. the spreader truck further comprises a dispenser and material movement means to discharge the said material such that d. the spreader truck drives over an area having a post-dispensed surface and a pre-dispensed surface lower than the post-dispensed surface, and e. each said vacuum hood is located adjacent to the dispenser, f. the vacuum generating means is located outside the truck, g. the venting pipe is substantially inside the material storage area, and h. the filter unit is mounted on the outside of the material storage unit.

8. A spreader truck comprising the vacuum system of claim 6 in which a. the material storage area is a vessel for storing a volume of material, b. the inlet of the loading pipe may be uncoupled from the communication means between the loading pipe and the the outlet of the vacuum generating unit, c. the spreader truck further comprises a dispenser and material movement means to discharge the said material such that d. the spreader truck drives over an area having a post-dispensed surface and a pre-dispensed surface lower than the post-dispensed surface, and e. the first vacuum hood is located adjacent to the dispenser and caudal from both the dispenser and from the front of the material storage area, and i. comprises a width and a depth, a) said width being perpendicular to the material storage areas's longitudinal axis and substantially the same same width as the material storage area, and b) said depth being parallel to the material storage area's longitudinal axis, and;

f. the second vacuum hood is located adjacent to the dispenser and rostral from the said dispenser and caudal from the front of the material storage area, and i. comprises a width and a depth, a) said width being perpendicular to the material storage areas's longitudinal axis and substantially the same same width as the material storage area, and b) said depth being parallel to the material storage area's longitudinal axis, and;

g. the vacuum generating means is located outside the truck, h. the venting pipe is substantially inside the material storage area, and i. the filter unit is mounted on the outside of the material storage unit.

9. A spreader truck comprising the vacuum system of claim 6 in which a. the material storage area is a vessel for storing a volume of material, b. the inlet of the loading pipe may be uncoupled from the communication means between the loading pipe and the the outlet of the vacuum generating unit, c. the spreader truck further comprises a dispenser and material movement means to discharge the said material such that d. the spreader truck drives over an area having a post-dispensed surface and a pre-dispensed surface lower than the post-dispensed surface, and e. the first vacuum hood is located adjacent to the dispenser and caudal from both the dispenser and from the front of the material storage area, and i. comprises a width and a depth, a) said width being perpendicular to the material storage areas's longitudinal axis and substantially the same same width as the material storage area, and b) said depth being parallel to the material storage area's longitudinal axis, and further comprises a curtain of material having a top and a bottom, (1) said top being attached to the vacuum hood, and (2) said bottom extending substantially to the post-dispensed surface; and f. the second vacuum hood is located adjacent to the dispenser and rostral from said dispenser and caudal from the front of the material storage area, and i. comprises a width and a depth, a) said width being perpendicular to the material storage areas's longitudinal axis and substantially the same same width as the material storage area, and b) said depth being parallel to the material storage area's longitudinal axis, and further comprises a curtain of material having a top and a bottom,
(1) said top being attached to the vacuum hood, and
(2) said bottom extending substantially to the post-dispensed surface; and g. the first vacuum hood's said curtain and the second vacuum hood's said curtain are continuous and form a single curtain surrounding both first and second vacuum hoods and the dispenser; and h. the vacuum generating means is located outside the truck, i. the venting pipe is substantially inside the material storage area, and j. the filter unit is mounted on the outside of the material storage unit.

10. A spreader truck comprising the vacuum system of claim 6 in which a. the material storage area is a vessel for storing a volume of material, b. the inlet of the loading pipe may be uncoupled from the communication means between the loading pipe and the the outlet of the vacuum generating unit, c. the outlet of the loading pipe is located within the material storage area and is oriented so air and material is blown towards the front of the material storage area, and d. the spreader truck further comprises a dispenser and material movement means to discharge the said material such that e. the spreader truck drives over an area having a post-dispensed surface and a pre-dispensed surface lower than the post-dispensed surface, and f. the first vacuum hood is located adjacent to the dispenser and caudal from both the dispenser and from the front of the material storage area, and i. comprises a width and a depth,
a) said width being perpendicular to the material storage areas's longitudinal axis and substantially the same same width as the material storage area, and
b) said depth being parallel to the material storage area's longitudinal axis, and further comprises a curtain of material having a top and a bottom,
(1) said top being attached to the vacuum hood, and
(2) said bottom extending substantially to the post-dispensed surface; and g. the second vacuum hood is located adjacent to the dispenser and rostral from said dispenser and caudal from the front of the material storage area, and i. comprises a width and a depth,
a) said width being perpendicular to the material storage areas's longitudinal axis and substantially the same same width as the material storage area, and
b) said depth being parallel to the material storage area's longitudinal axis, and further comprises a curtain of material having a top and a bottom,
(1) said top being attached to the vacuum hood, and
(2) said bottom extending substantially to the post-dispensed surface; and h. the first vacuum hood's said curtain and the second vacuum hood's said curtain are continuous and form a single curtain surrounding both first and second vacuum hoods and the dispenser; and i. the vacuum generating means is located outside the truck, j. the venting pipe is substantially inside the material storage area, and k. the inlet of the loading pipe is oriented so that it faces the rear of the material storage area, and l. the filter unit is mounted on the outside of the material storage unit.

* * * * *